United States Patent [19]

Pezzoli et al.

[11] Patent Number: 5,042,534

[45] Date of Patent: Aug. 27, 1991

[54] HEALD FRAME FOR WEAVING LOOMS OF ASYMMETRICAL CONFIGURATION

[75] Inventors: Luigi Pezzoli, Leffe; Paolo Fantoni, Villa d'Ogna, both of Italy

[73] Assignee: Vamatex S.p.A., Villa Di Serio, Italy

[21] Appl. No.: 457,312

[22] Filed: Dec. 26, 1989

[30] Foreign Application Priority Data

Jan. 9, 1989 [IT] Italy ..... 19025 A/89

[51] Int. Cl.[5] ..... D03C 9/06

[52] U.S. Cl. ..... 139/91; 139/92; 139/93

[58] Field of Search ..... 139/93, 96, 82, 29, 139/88, 91, 92

[56] References Cited

U.S. PATENT DOCUMENTS

| | | | |
|---|---|---|---|
| 1,873,726 | 8/1932 | Strohacker | 139/92 |
| 3,088,496 | 5/1963 | Houghton et al. . | |
| 4,036,263 | 7/1977 | Kaufmann | 139/91 |
| 4,635,685 | 1/1987 | Chabot | 139/91 |
| 4,658,864 | 4/1987 | Goodman, Jr. | 139/91 |

FOREIGN PATENT DOCUMENTS

| | | |
|---|---|---|
| 678345 | 3/1966 | Belgium . |
| 1498551 | 10/1967 | France . |
| 335006 | 2/1959 | Switzerland . |

*Primary Examiner*—Andrew M. Falik

*Attorney, Agent, or Firm*—Young & Thompson

[57] ABSTRACT

In a heald frame for weaving looms, wherein the two heald slide bars consist of standard elongated sections, the lower heald slide bar is formed of an elongated section forming the upper heald slide bar.

2 Claims, 1 Drawing Sheet

HEALD FRAME FOR WEAVING LOOMS OF ASYMMETRICAL CONFIGURATION

BACKGROUND OF THE INVENTION

The present invention concerns a heald frame for weaving looms characterized by an extremely simple structure, the asymmetrical configuration of which has proved to be surprisingly advantageous.

It is known that, in weaving looms, the problem arises of giving to the heald frames a structure adapted to guarantee, without any excessive weight, a rigid behavior of such frames in dynamic conditions. In substance, it is necessary to avoid, or anyhow reduce to a minimum, the relative strains which, in dynamic conditions, tend to arise between the heald slide bars forming each frame (generally, elongated extruded sections), so as to reduce the dynamic flexural component which causes the breaking of the yarn.

In the past, said problem has been solved by inserting an intermediate tie rod connecting the two heald slide bars of the frame, so as to keep the distance between them constant during the working of the loom, or by stiffening the structure of the frame through increase of the moment of inertia of the heald slide bars, or finally by using, to form the heald slide bars, special composite materials of high rigidity and low weight.

The first two of these solutions have proved to be very scarcely practical, particularly as they create undesired bulk, they can cause interference with the warp yarns, and they considerably increase the mass and thus the inertia of the heald frames, while the third one involves excessive costs, taking into account the specific field of application.

SUMMARY OF THE INVENTION

The present invention now proposes an original and fully unexpected solution to the above problem, by giving to the heald frames an asymmetrical configuration which guarantees an extremely advantageous behavior of such frames in respect of the strains in dynamic conditions.

In substance, the present invention concerns a heald frame for weaving looms, of the type wherein the two heald slide bars consist of standard elongated sections, characterized in that it comprises a lower heald slide bar formed of an elongated section of smaller width than that of the elongated section forming the upper heald slide bar.

Preferably, in practice, the upper heald slide bar is formed from a standard type extruded section 120 mm wide, while the lower heald slide bar is formed from a standard type extruded section 96 mm wide.

BRIEF DESCRIPTION OF THE DRAWINGS

The invention is now described in further detail, with reference to the accompanying drawing, which shows an embodiment of the heald frame for weaving looms according to the invention, as compared to the known type heald frames. In said drawing.

DESCRIPTION OF THE PREFERRED EMBODIMENT

Figure 2:
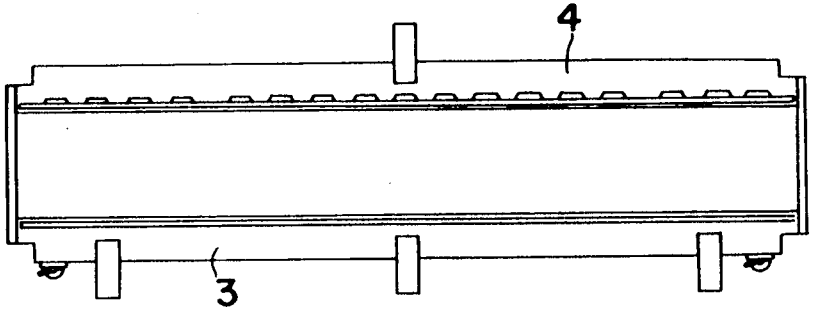
FIG. 2 PRIOR ART
FIGS. 1 and 2 are front views showing a first and a second type of conventional heald frame.
Figure 1:
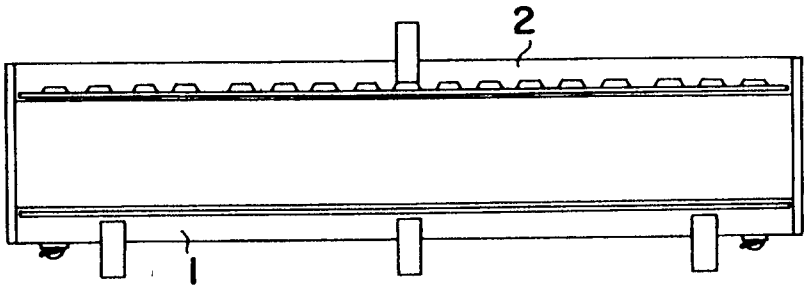
FIG. 1 PRIOR ART

With reference to the drawing, it can be seen how conventional heald frames had a symmetrical configuration, being formed with a pair of identical heald slide bars consisting of elongated narrow sections 1 and 2 (FIG. 1), for example of the standard type having a width of 96 mm, or else of elongated wide sections 3 and 4 (FIG. 2), for example of the standard type having a width of 120 mm.

These frames had the drawbacks which have already been described.

Figure 3:
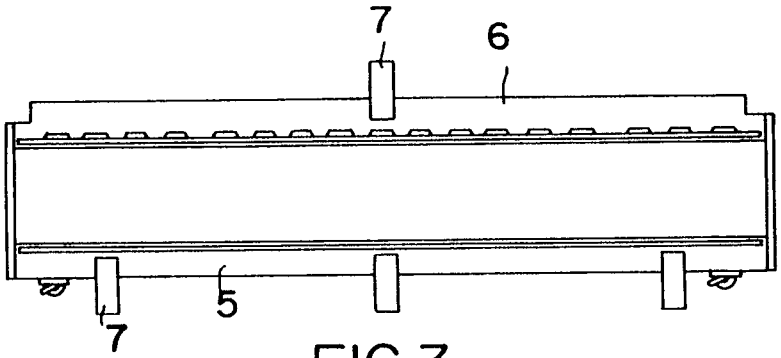
FIG. 3 is the front view of the heald frame according to the invention.

According to the invention, a heald frame is formed with the asymmetrical configuration shown in FIG. 3 using, to form the lower heald slide bar designed to be connected to the weaving machine, a standard type elongated narrow section 5 having a width of 96 mm and, to form instead the upper heald slide bar, a standard type elongated wide section 6 having a width of 120 mm.

With this asymmetrical configuration—totally unforeseeable since, going by intuition, it could have been thought to obtain an advantage by extending the width of the lower heald slide bar rather than that of the upper one—the already considered problems are efficiently solved. Surprisingly, in fact, the dynamic behavior of the frames is thereby considerably improved—as has been experimentally proved—without giving rise to weight and bulk increases apt to cause inconveniences.

This behavior can be explained by observing that, in the case of conventional symmetric heald frames, the strains in both heald slide bars are generally directed in different senses, as well as being of different intensity. But in the case of the asymmetrical heald frame according to the invention, both heald slide bars deflect in the same sense, even if to a slightly different extent one in respect of the other: in this way, the frame behaves dynamically, keeping substantially unvaried distances between corresponding points of the two heald slide bars (no or practically no relative flexure); the breaking of the frame stitches, which easily occurs in the case of conventional frames—unless their structure is strengthened—is thus prevented in the frame according to the invention, without having to resort to the disadvantageous devices of known technique, with evident considerable progress.

It should be noted that the proposed solution, as well as being extremely economic, in that it uses interchangeable parts which are already widely used in this field of technique, also keeps the weight and inertia low, in that it strengthens the structure of only one of the heald slide bars of the frame and, above all, it does not introduce any kind of supplementary bulk.

It has also been found that the heald frame according to the invention behaves particularly well at the high speeds, even in the case of working with unbalanced weaves, as is indispensable in certain types of weaving.

When speaking of "width" in the above text, it is of course to be understood that reference is made to the dimensions that appear as the heights of the members 2–6 in the drawing.

As in conventional, the two heald bars 5 and 6 are rigidly connected at their ends to the heald frame and are supported by brackets 7.

We claim:

1. In a weaving loom wherein the improvement comprises, a heald frame including an upper and lower slide bar each rigidly connected at their ends to the frame, characterized in that the lower heald slide bar is formed of an elongated section of width smaller than that of the elongated section forming the upper heald slide bar.

2. The structure as in claim 1, wherein the upper heald slide bar is 120 mm wide, while the lower heald slide bar is 96 mm wide.

* * * * *